United States Patent [19]

Rosenthal

[11] 3,938,947

[45] Feb. 17, 1976

[54] DEVICE FOR FEEDING AN EXPANDED GASEOUS FUEL TO A BURNER NOZZLE FOR INSTANCE OF A LIGHTER AND LIGHTER SUCH AS A CIGARETTE LIGHTER PROVIDED WITH SUCH A DEVICE

[75] Inventor: Claude Roland Julius Rosenthal, Paris, France

[73] Assignee: Uniflam, Societe Anonyme, Societe Universelle des Flammes, Luxemburg

[22] Filed: Dec. 4, 1974

[21] Appl. No.: 529,578

[30] Foreign Application Priority Data

Dec. 10, 1973 France ..... 73.44028

[52] U.S. Cl. ..... 431/344; 431/254; 431/277; 251/121

[51] Int. Cl.[2] ..... F23D 13/04

[58] Field of Search ..... 431/130, 131, 142, 150, 431/254, 276, 277, 344; 251/120, 121

[56] References Cited

UNITED STATES PATENTS

| | | | |
|---|---|---|---|
| 3,367,148 | 2/1968 | Bourderau | 431/276 |
| 3,499,719 | 3/1970 | Kitabayashi | 431/344 |

*Primary Examiner*—Carroll B. Dority, Jr.
*Attorney, Agent, or Firm*—Steinberg & Blake

[57] ABSTRACT

Lighter comprising a fuid-tight casing containing liquified gas under pressure, a valve member slidably mounted in said casing and having a compressible porous member forming a pressure reducing means which, in a first position of said valve member, is separated from said liquified gas under pressure and which, in a second position of the valve member, is fed with liquified gas and supplies a burner nozzle with expanded gas.

16 Claims, 2 Drawing Figures

Figure 1:
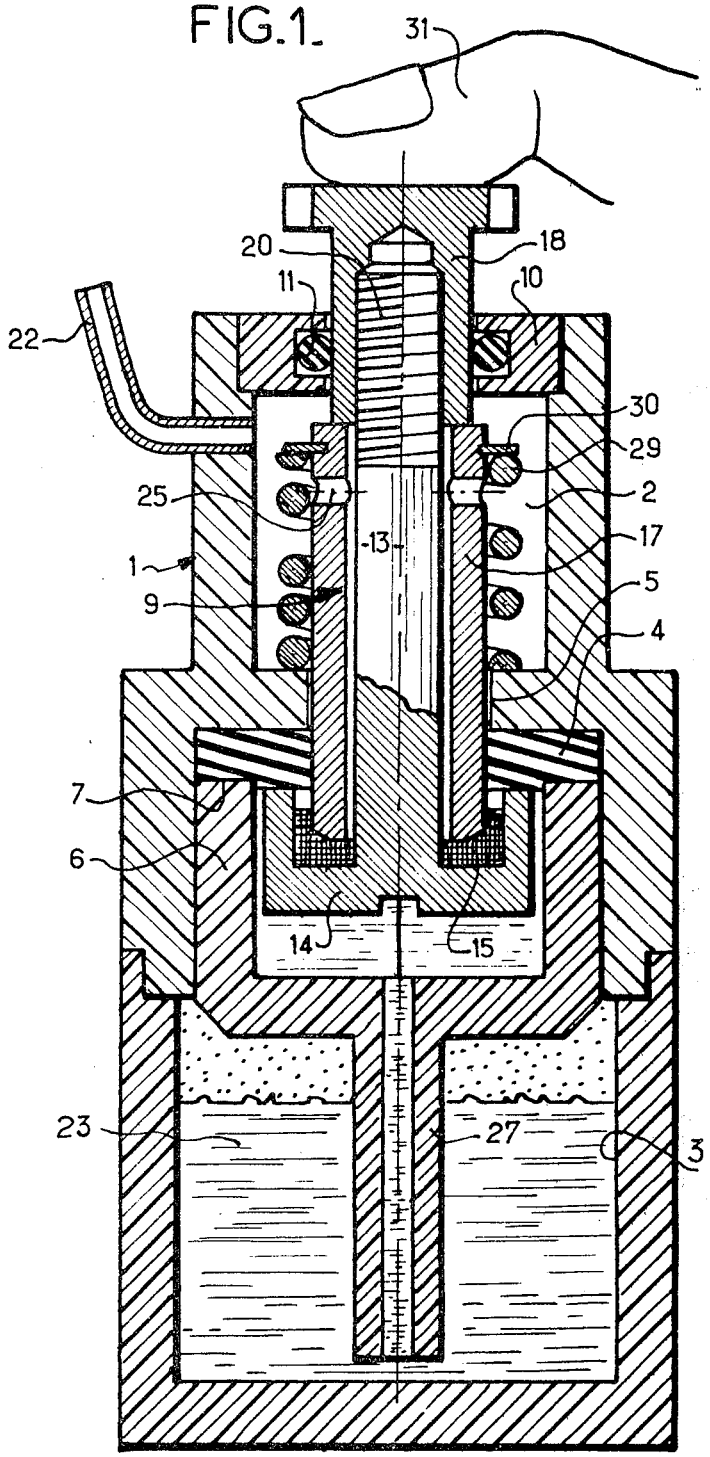

DEVICE FOR FEEDING AN EXPANDED GASEOUS FUEL TO A BURNER NOZZLE FOR INSTANCE OF A LIGHTER AND LIGHTER SUCH AS A CIGARETTE LIGHTER PROVIDED WITH SUCH A DEVICE

The invention relates essentially to a device for feeding an expanded gaseous fuel to a burner nozzle for instance of a lighter such as a gas lighter or a cigarette lighter, of the kind comprising a liquified gaseous fuel tank under pressure, a pressure reducing member enabling the vaporization and expansion of the liquified gas under pressure and a feed valve for supplying a burner nozzle with expanded gaseous fuel which will then be ignited at the outlet of this burner nozzle by any suitable means, for instance by a serrated wheel rubbing against or in frictional contact with a flint, by a conducting filament made red-hot or raised to red heat by the flowing of an electric current therethrough or by means of sparks generated between electrodes connected to a piezo-crystal compressed by the user or operator.

The lighters such as the gas lighters, cigarette lighters or the like of this kind are often subject to a defective operation which is due either to the fact the pressure reducing member is not always fed properly with liquified gas under pressure for instance in the case where a gas bubble is building up at the pressure reducing member or to the fact that this pressure reducing member is constantly wetted by the liquified gas under pressure thereby resulting in flame jumps at the outlet of the burner nozzle or jet upon putting the flame on or out.

Moreover these devices of the prior known state of the art generally exhibit a complicated construction which significantly increases their cost prices.

In order to overcome these inconveniences, the invention provides a device for feeding expanded gaseous fuel to a burner nozzle or jet for instance of a lighter comprising a sealed or fluid-tight enclosure or like casing divided by a resilient sealing element into a pair of chambers the first one of which communicates with a the burner nozzle or jet whereas the second one contains liquified gas under pressure, a valve member formed with a cylindrical bearing area portion inserted in sealing relationship into a cylindrical opening of the sealing element and axially movable within said enclosure or casing, a compressible porous unit forming a pressure reducing member which is mounted in said second chamber onto said valve member and which is connected through a duct or like passageway to said first chamber, said device being characterized in that that end of the valve member which is located within the second chamber comprises a cup-shaped or dished head inside of which is arranged said porous unit which in a first axial position of the valve member within said enclosure or casing is separated from the liquified gas under pressure by said head engaging in pressed sealing relationship said resilient element and which in a second axial position of the valve member in which said head is spaced or disengaged from the sealing element is supplied with liquified gas under pressure and feeds expanded gas to said burner nozzle through the medium of said passageway or duct and said first chamber.

All the inconveniences of the prior art devices are avoided according to the invention owing to the fact that the pressure reducing member although placed in the second chamber containing the liquified gas under pressure is selectively supplied with liquified gas under pressure by the axial displacement of the valve member and that the burner nozzle while communicating with the first chamber may not be fed with expanded gaseous fuel through the passageway provided in the pressure reducing porous member. Thereby are prevented the flame jumps when igniting and extinguishing the flame and the structure of this expanded gaseous fuel feeding device is significantly simplified so that it may be manufactured at a relatively low cost price.

Figure 2:
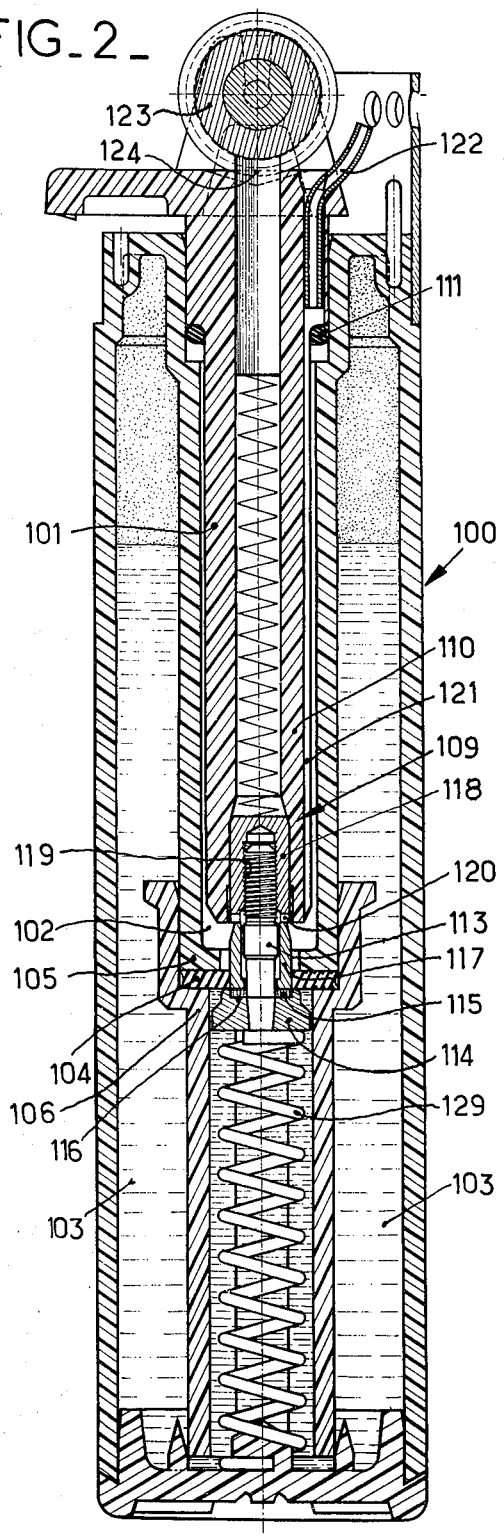

The invention will be better understood and further objects, characterizing features, details and advantages thereof will appear more clearly as the following explanatory description proceeds with reference to the accompanying diagrammatic drawings illustrating by way of non-limitative examples only two presently preferred forms of embodiment of the invention and wherein:

FIG. 1 is a view in longitudinal axial section of an expanded gaseous fuel feeding device according to the invention; and FIG. 2 is a view in longitudinal axial section of a cigarette lighter comprising another expanded gas feeding device in accordance with the invention.

In these Figures the device is shown in the closed position, i.e. the burner nozzle or jet is not fed with expanded gaseous fuel.

This device shown in FIG. 1 comprises a fluid-tight enclosure or like sealed casing or housing generally denoted by the reference numeral 1 and which includes a first chamber 2 and a second chamber 3 separated from each other by a resilient sealing element or gasket 4 which in this form of embodiment is a flat washer of rectangular cross section made from resilient material such as rubber or the like. The bottom portion of the first chamber 2 comprises an inner shoulder or collar 5 below which is located the resilient sealing element or gasket in pressed engagement therewith. A dished or cup-shaped insert member 6 is mounted with a force or a tight fit and secured within the second chamber 3 so that the annular end surface 7 of the top edge of the part 6 bear aganist the sealing element 4 and press the same against said shoulder 5. Thus this element is kept stationary within the closed casing 1.

A control valve member generally denoted by the reference numeral 9 is disposed within the casing 1 in coaxial relation therewith and extends in sealing relationship through the top end wall 10 of the casing 1 and of said chamber 2. For this purpose a toroidal or like ring-shaped seal 11 carried by the wall 10 engages in fluid tight relationship the outer cylindrical surface of the upper end of the valve member 9.

This valve member 9 consists essentially of a cylindrical shank, spindle or like rod 13 of circular cross section the lower portion of which located within the chamber 3 carries a head 14 forming a cup the concavity of which is facing towards said chamber 2. Inside of the head 14 and about the base of said cylindrical rod 13 is arranged a compressible porous unit 15 forming a pressure reducing member which is pressed onto the bottom of the cup and about the rod 13 by a hollow cylindrical sleeve 17 slipped over the rod 13 and itself urged in pressing relationship towards the head 14 of the valve member by a threaded socket 18 screwed onto the upper threaded end portion 20 of the rod 13. The bottom end portion of the threaded socket 18 bears against the top edge of the sleeve 17 and through a more or less marked screwing of this socket 18 onto the rod 13 the compressible porous unit 15 forming the pressure reducing member is more or less compressed against the bottom of the head 14.

A burner nozzle or jet 22 communicates with the inside of said chamber 2 and is adapted to be supplied with expanded gaseous fuel from said lower chamber 3 which is filled at least partially with liquified gas under pressure 23.

The ring-shaped terminal surface of the outer top edge of the head 14 is bearing in sealing relationship against the underside of the resilient sealing element or gasket 4 when the valve member 9 assumes a first axial closing position shown in FIG. 1. The cylindrical sleeve 17 surrounding the shank or spindle 13 of the valve member has an inside diameter slightly larger than that of the shank 13 so that a free annular space or gap is left between the shank 13 and the sleeve 17 which communicates at its bottom directly with the pressure reducing porous member 15 and which may open into the upper chamber 2 through any port 25 formed radially through the thickness of the sleeve 17.

The aforesaid part 6 which is mounted with a force or tight fit in the upper portion of the chamber 3 advantageously has the shape of a cup the size of which is slightly larger than that of the head 14 of the valve member. The bottom of the cup consisting of this part 6 communicates through a depending dip pipe 27 of relatively small inside diameter with the bottom portion of the lower chamber 3 containing the liquified gas under pressure.

Resilient drawback means for urging or biasing the valve member 9 to the position shown in FIG. 1 are provided inside of the chamber 2 and consist for instance of a helical coil return spring 29 surrounding the hollow cylindrical sleeve 17 and bearing on the one hand onto the top face of the shoulder 5 and on the other hand against a ring-shaped flange or collar 30 integral with or rigidly fastened to the upper portion of the sleeve 17.

The operation of this device according to the invention is the following:

In the position shown in FIG. 1, the liquified gas under pressure located inside of the chamber 3 is fed through the dip pipe 27 and the insert part 6 to the space or cavity surrounding the head 14 of the valve member 9. As however the top edges of the head 14 are in sealing pressed engagement with the resilient sealing member or gasket 4 the pressure reducing porous member 15 is completely separated from the liquified gas under pressure.

When the valve member 9 is caused to be displaced downwards by being depressed inwards into the casing 1 for instance through the applied pressure of a finger 31 as shown the head 14 of the valve member moves downwards towards the bottom of the insert part 6 and accordingly away from the sealing element or gasket 4. The pressure reducing porous member 15 is therefore fed directly with liquified gas under pressure. The flow of the liquified gas through the material of the compressible porous unit 15 results in its vaporization and expansion and the thus expanded gaseous fuel may escape only by flowing through the annular clearance gap left between the rod 13 and the sleeve 17 and then through the port 25 into the chamber 2 from which it flows outwards through the burner nozzle or jet 22. This expanded gas may be ignited at the outlet of the burner nozzle 22 by any suitable means.

When the finger 31 releases its pressure onto the outer top end of the valve member 9, the biasing spring

29 moves the valve member 9 back to the position shown in FIG. 1 so that the ring-shaped top edge of the head 14 is again caused to apply in sealing relationship against the sealing element or like packing 4. The residual liquified gas which is soaking in or permeating through the pressure reducing porous member 15 vaporizes and expands normally and still feeds for a very short time the burner nozzle 22 with expanded gaseous fuel. Owing to the fact that this burner nozzle or jet 22 is necessarily supplied with gas which has been expanded by flowing through the porous member 15 there may not occur in this form of embodiment any sudden vaporization of the liquified gas thereby preventing any flame jump at the outlet of the burner nozzle 22.

The control or adjustment of the flow rate of the expanded gaseous fuel is very easily carried out by a more or less extended screwing of the socket 18 on the threaded tip portion of the rod 13.

Moreover due to the fact that the dip pipe 27 extends downwards to the vicinity of the bottom wall of the chamber 3 containing the liquified gas under pressure and that its inside diameter is relatively small the gas under pressure located above the free surface of the liquidfied gas 23 may not flow into the dip pipe 27 whatever the position or the relative slope of the device according to the invention may be. Thus is also prevented any feed of gas under pressure into the insert part 6 which would result in a feed of gas under pressure to the pressure reducing porous member 15 and lead to the extinction of the flame at the outside of the burner nozzle 22.

It should be pointed out that in this form of embodiment of FIG. 1 the sealing gasket 4 is slightly sqeezed or compressed between the shoulder 5 and the ring-shaped terminal surface 7 of the insert part 6 so as to achieve a perfect seal or fluid-tightness between the chambers 2 and 3 on the one hand and along the outer cylindrical surface of the sleeve 17 on the other hand and that it is practically kept stationary or retained in a fixed position within the casing 1 during the motion or travel of the valve member 9.

It is however of course obvious that the edges of the aperture formed in the gasket 4 through which the valve member 9 is sliding could be made to engage a groove or like circumferential recess provided in the outer surface of the sleeve 17 so that upon a motion of the valve member 9 the edges of the aperture of the gasket 4 would be caused to displace and to strain or deform partially and resiliently. It should also be noted that the insert part 6 has an inner cross section of polygonal shape which corresponds to the cross sectional configuration of the surface of the head 14 of the valve member 9 so that the latter is held against rotary motion within the insert part 6.

In FIG. 2 is shown a view in longitudinal section of a cigarette lighter according to the invention. It comprises a cylindrical body 100 forming a tank filled at least partially with liquified fuel gas under pressure. This body portion 100 is closed by an added bottom plug fitted thereon and comprises at its upper portion an inner coaxial depending dip pipe 101 terminating in a shoulder 105 and extended downwards or towards the bottom by a tubular member 106 of inner polygonal cross sectional contour mounted in sealing relationship with a force or tight fit onto the lower end portion of the dip pipe 101. A flat sealing gasket or like ring-shaped packing is clamped between the shoulder 105 and a corresponding shoulder of the tubular member 106 and divides the inner space into a pair of separate chambers 102 and 103 the first one of which is selectively fed with expanded gas whereas the second one is constantly supplied with liquified gas under pressure.

A control valve member 109 is arranged within the dip pipe 105 and carries at its upper end portion the burner nozzle or jet 122 and igniting means for kindling the expanded gas such for instance as a serrated wheel or roller 123 rubbing or frictionally contacting a flint 124. A sealing gasket 111 is arranged within the dip pipe about the upper portion of the valve member between a shoulder of this valve member top end portion and a mating or complementary shoulder of the dip pipe and prevents any leak of the expanded gas.

This valve member 109 consists of a cylindrical tube portion 110 the bottom end portion of which is closed by a cylindrical metallic part 118 formed with a threaded or tapped blind hole 119 opening towards the second chamber 103.

A rod, stem or pin 113 the threaded upper end portion of which is screwed into the blind hole 119 is rigidly connected at its bottom end portion to a member 114 of polygonal cross sectional contour slidably fitted into the lower tubular member underneath the sealing gasket 104 and the top face of which is formed with an annular cavity or counter-bore 116 in which is disposed about the stem or rod 113 a compressible resilient porous ring-shaped member 115 forming a pressure reducing means. The latter is adjustably urged in pressed relationship towards the bottom of the cavity 116 by a hollow cylindrical sleeve or bushing 117 through which the pin 113 is extending with a small clearance and which is clamped between the pressure reducing means 115 and the metallic part 118. The outer cylindrical surface of this sleeve or bushing 117 is engaged in fluid-tight relationship by a ring-shaped sealing gasket or like packing 104.

A spring 129 is seated in the second chamber 103 between the bottom and the member 114 and presses the latter against the sealing gasket 104. The lip-shaped edge forming for instance a bevelled or tapered rim of the cavity 116 pressed against the gasket 104 by the spring 129 thereby achieves a perfect seal and effectively separates the pressure reducing means 115 from the liquified gas under pressure.

It is clear that through a pressure exerted onto the top end of the valve member 109 the pressure reducing means 115 is supplied with liquified gas under pressure and feeds the chamber 102 and the burner nozzle or jet 122 with expanded gas. The expanded gas flows through the small annular clearance gap left between the pin or stem 113 and the sleeve 117 and then into the chamber 102 for instance through grooves or slots 120 formed in the part 118 or in the upper end portion of the sleeve 117. A fine or narrow longitudinal groove 121 in the outer surface of the tube portion 110 extending radially into the sealing joint member 111 directly feeds the gas to the burner nozzlz 122.

The control or adjustment of the flow rate of the expanded gas is carried out by turning the tube portion 110 in one or the other direction thereby resulting in a more or less strong compression of the pressure reducing means 115 by the sleeve 117.

It should be pointed out that as in the preceding form of embodiment the gas may not at all events be fed to the burner nozzle without having previously flowed through the pressure reducing means.

Furthermore, since the lower tubular member 106 is ending in close proximity of the inner wall face of the added bottom plug or like closure or cover, an interstitial annular clearance is left therebetween which is only sufficient for allowing a feed with liquified gas but prevents the passage of any gaseous bubble in the case where the cigarette lighter would assume an inclined, horizontal, inverted, upset ot overturned position owing to the fact that a liquid ring then remains through capillarity between the lower end portion of the tubular member 106 and the bottom and forms a liquid barrier.

It should be understood that the invention is not at all limited to the forms of embodiment described and shown which have been given by way of examples only. In particular it comprises all the means constituting technical equivalents of the means described as well as their combinations if the latter are carried out according to its gist and used within the scope of the appended claims.

What is claimed is:

1. A feeding device for supplying expanded fuel gas to a burner nozzle for instance of a lighter, comprising a sealed or fluid-tight casing divided by a resilient sealing element into a pair of chambers the first one of which communicates with said burner nozzle whereas the second one contains liquified gas under pressure, a valve member formed with a cylindrical bearing area portion inserted in sealing relationship through a cylindrical aperture formed in said sealing element and axially displaceable within said casing, a compressible porous member forming a pressure reducing means which is mounted in said second chamber onto said valve member and is connected through a passageway duct to said first chamber, wherein the improvement consists in that that end portion of said valve member which is located within said second chamber comprises a cup-shaped head in which is disposed said porous member which in a first axial position of said valve member within said casing is separated from said liquified gas under pressure by said head pressed in sealing engaging relationship against said resilient element and which in a second axial position of said valve member in which said head is spaced away from said sealing element, is fed with liquified gas under pressure and supplies said burner nozzle with expanded gas through the medium of said passageway duct and said first chamber.

2. A device according to claim 1, wherein said cylindrical bearing area portion of said valve member is slidably mounted in the cylindrical aperture of said sealing element.

3. A device according to claim 1, wherein the edges of the aperture of said sealing element engage a circumferential groove of the outer surface of said cylindrical bearing area portion of said valve member and are displaced and resiliently strained or deformed by the motion of the latter.

4. A device according to claim 1, wherein said valve member comprises a cylindrical stem the end of which located in said second chamber carries said cup-shaped head, a hollow cylindrical sleeve inside of which is disposed said cylindrical stem of said valve member and the outer surface of which forms said cylindrical bearing area portion engaged by said sealing element as well as adjusting means mounted on that other end of said stem which is opposite from said head for more or less urging one end of said sleeve in pressing relationship against said porous member placed inside of the head of said valve member and thereby adjusting the flow rate of said expanded gas.

5. A device according to claim 4, wherein said passageway duct between said pressure reducing porous member and said first chamber consists essentially of the annular clearance gap left between the outer surface of said cylindrical stem and the inner surface of said sleeve.

6. A device according to claim 4, wherein said passageway duct left between said pressure reducing porous member and said first chamber opens into said first chamber through a port extending through the wall of said cylindrical sleeve.

7. A device according to claim 4, wherein said other end of said cylindrical valve stem is threaded and screwed into a cylindrical socket threaded inside and forming said adjusting means.

8. A device according to claim 7, wherein said cylindrical socket extends in sealing relationship through an end wall of said casing forming the top wall of said first chamber.

9. A device according to claim 1, wherein said sealing element is a flat annular gasket made from resilient material and of substantially rectangular cross section.

10. A device according to claim 1, wherein said sealing element is mounted so as to be in engagement with an inner annular shoulder of said first chamber and is pressed against said shoulder by one annular end of a cylindrical insert part mounted with a tight fit within said second chamber and inside of which is disposed said valve head.

11. A device according to claim 10, characterized in that said insert part has the shape of a cup the height of which is slightly larger than that of said valve head and the bottom of which communicates through a depending dip pipe with the lower portion of said first chamber containing said liquified gas under pressure.

12. A device according to claim 10, wherein said inner surface of said insert part has a polygonal cross section corresponding to that of the outside surface of said valve head.

13. A device according to claim 1, wherein said valve member is provided with resilient biasing means for returning it to said first axial position in which said pressure reducing porous member is no longer fed with liquified gas under pressure.

14. A lighter such as a cigarette lighter fitted with a feeding device according to claim 1.

15. A lighter according to claim 14, wherein said cylindrical stem is screwed with its end opposite from said cup-shaped head into a metal part closing the bottom end of a cylindrical tube portion which forms said valve member and carries at its top end said burner nozzle and igniting means for kindling the expanded gas flowing out from said burner nozzle.

16. A lighter according to claim 15, wherein said resilient biasing means for said valve member consist of a spring arranged in said second chamber between said cup-shaped head and the bottom of said casing and pressing the edge of said head in sealingly engaging relationship against said resilient sealing element.

* * * * *